US005860162A

United States Patent [19]

Love

[11] Patent Number: 5,860,162

[45] Date of Patent: Jan. 19, 1999

[54] INFLATABLE FIREPROOF AVIATION BODY SUIT

[76] Inventor: Roy M. Love, 9308 Compton Blvd., Apt. 32, Bellflower, Calif. 90706

[21] Appl. No.: 955,986

[22] Filed: Oct. 22, 1997

[51] Int. Cl.[6] ..... A41D 13/00; A62D 7/00

[52] U.S. Cl. ..... 2/2.14; 2/2.12; 2/6.3; 2/458; 2/81

[58] Field of Search ..... 2/2.11, 2.12, 2.14, 2/2.15, 455, 456, 457, 458, 23, 24, 76, 6.3; 405/186; 600/20; 128/201.29, 202.11, 205.12, 205.28

[56] References Cited

U.S. PATENT DOCUMENTS

| | | | |
|---|---|---|---|
| 3,421,158 | 1/1969 | Bonardi | 2/2.14 |
| 4,065,814 | 1/1978 | Fox | 2/79 |
| 4,068,312 | 1/1978 | Ledesma | 2/24 |
| 4,089,065 | 5/1978 | McGee | 2/456 |
| 4,598,427 | 7/1986 | Vykukal | 2/2.12 |
| 4,977,623 | 12/1990 | DeMarco | 2/456 |
| 5,007,893 | 4/1991 | Row | 600/20 |
| 5,091,992 | 3/1992 | Pusic | 2/DIG. 3 |
| 5,309,571 | 5/1994 | Huang | 2/458 |

*Primary Examiner*—Michael A. Neas
*Assistant Examiner*—Tejash D. Patel

[57] ABSTRACT

A protective flight suit is provided including a flexible inflatable suit constructed from a heat and flame resistant material. The inflatable suit has a plurality of discrete inflatable portions including a body portion, a pair of leg portions, and a hood portion. A carbon dioxide canister is mounted on the suit with a release mechanism coupled thereto. The canister is adapted to dispense carbon dioxide gas from an outlet thereof upon the actuation of the release mechanism. Next provided is a plurality of carbon dioxide tubes each coupled between the outlet of the carbon dioxide canister and the respective portion of the suit for inflating the same upon the actuation of the release mechanism associated with the carbon dioxide canister.

9 Claims, 3 Drawing Sheets

FIG. 6
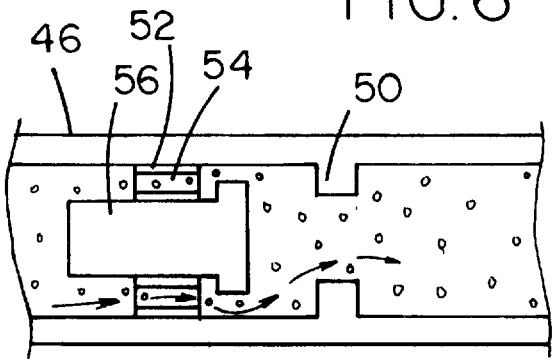
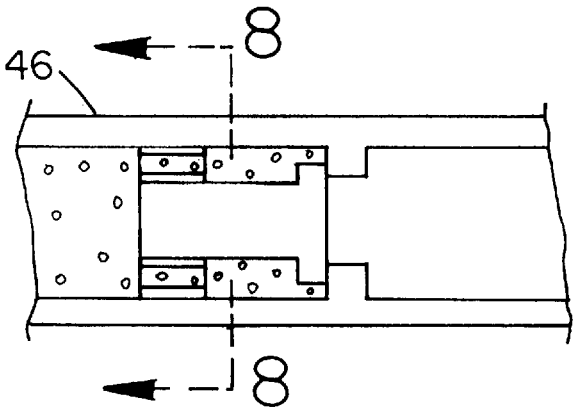
FIG. 7
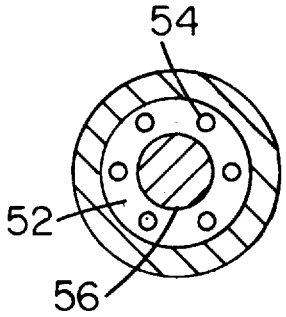
FIG. 8
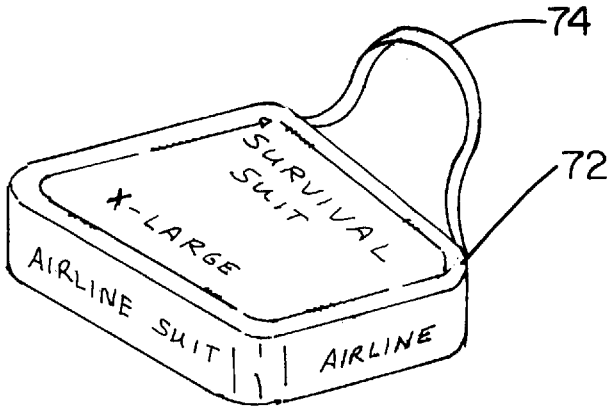
FIG. 9

INFLATABLE FIREPROOF AVIATION BODY SUIT

BACKGROUND OF THE INVENTION

1. Field of the Invention

The present invention relates to flight suits and more particularly pertains to an inflatable fireproof aviation body suit for protecting a user during a plane crash.

2. Description of the Prior Art

The use of flight suits is known in the prior art. More specifically, flight suits heretofore devised and utilized are known to consist basically of familiar, expected and obvious structural configurations, notwithstanding the myriad of designs encompassed by the crowded prior art which have been developed for the fulfillment of countless objectives and requirements.

Known prior art flight suits include U.S. Pat. No. 5,309,571; U.S. Pat. No. 4,089,065; U.S. Pat. No. 4,637,074; U.S. Pat. No. 5,091,992; and U.S. Pat. No. 4,977,623.

In these respects, the inflatable fireproof aviation body suit according to the present invention substantially departs from the conventional concepts and designs of the prior art, and in so doing provides an apparatus primarily developed for the purpose of protecting a user during a plane crash.

SUMMARY OF THE INVENTION

In view of the foregoing disadvantages inherent in the known types of flight suits now present in the prior art, the present invention provides an inflatable fireproof aviation body suit construction wherein the same can be utilized for protecting a user during a plane crash.

The general purpose of the present invention, which will be described subsequently in greater detail, is to provide a inflatable fireproof aviation body suit apparatus and method which has many of the advantages of the flight suits mentioned heretofore and many novel features that result in a inflatable fireproof aviation body suit which is not anticipated, rendered obvious, suggested, or even implied by any of the prior art flight suits, either alone or in any combination thereof.

To attain this, the present invention generally comprises a flexible inflatable suit constructed from a heat and flame resistant material. The inflatable suit has a plurality of discrete inflatable portions including a body portion, a pair of arm portions, and a hood portion. As shown in FIGS. 1 & 2, the suit has a plurality of elastic bands mounted to bottoms of the leg and arm portions. An elastic band is further mounted about a midpoint of the body portion for conforming the suit to a body of a user. For permitting the suit to be easily put on and taken off, a zipper is mounted to a front side of the body portion of the suit. FIG. 4 shows one of a plurality of rigid joint guards each including a plurality of generally C-shaped segments. Each joint guard is pivotally coupled at ends thereof about a common axis. The ends are, in turn, coupled about a respective leg and arm portion for protecting a joint associated therewith. As shown in FIG. 3, a rigid helmet is provided with a semi-spherical configuration. During use, the rigid helmet is mounted to an exterior surface of the hood for protecting a head of the user. As best shown in FIG. 5, a carbon dioxide canister is mounted within the body portion of the suit on a first side of the zipper thereof. A release pull cord coupled to the carbon dioxide canister and extends from the suit for being gripped by the user. During use, the canister is adapted to dispense carbon dioxide gas from an outlet thereof upon the pulling of the cord. With reference still to FIG. 5, it is shown that a plurality of carbon dioxide tubes are each coupled between the outlet of the carbon dioxide canister and the respective portion of the suit. The tubes serve for inflating the portions upon the pulling of the cord associated with the carbon dioxide canister. Associated therewith is a plurality of valves each coupled within an associated one of the carbon dioxide tubes. Note FIGS. 6, 7 & 8. The valves each function to preclude the flow of carbon dioxide to one of the portions of the suit upon such portion being punctured. An oxygen canister is mounted within the body portion of the suit on a second side of the zipper thereof with a release pull cord coupled thereto. Similar to the pull cord associated with the carbon dioxide canister, the present pull cord extends from the suit for being gripped by the user. In operation, the oxygen canister is adapted to dispense oxygen gas from an outlet thereof upon the pulling of the cord. Coupled between the outlet of the oxygen canister and the hood of the suit is an oxygen tube. The oxygen tube is adapted for providing the user with oxygen upon the pulling of the cord associated with the oxygen canister. For directing oxygen into a space defined by the hood portion of the suit, a top extent of the oxygen tube preferably has an inverted L-shaped configuration. A transparent rigid mask is provided. The mask serves to be removably worn on a face of the user with the oxygen tube situated within the mask during use. Finally, a container is provided having a rectilinear configuration with a square top and bottom face and a thin periphery formed therebetween for defining an interior space to store the suit. See FIG. 9. The periphery is equipped with a flexible handle strap coupled thereto for totting purposes. When not in use, the container may be used as a seat cushion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a inflatable fireproof aviation body suit apparatus and method which has many of the advantages of the flight suits mentioned heretofore and many novel features that result in a inflatable fireproof aviation body suit which is not anticipated, rendered obvious, suggested, or even implied by any of the prior art flight suits, either alone or in any combination thereof.

It is another object of the present invention to provide a inflatable fireproof aviation body suit which may be easily and efficiently manufactured and marketed.

It is a further object of the present invention to provide a inflatable fireproof aviation body suit which is of a durable and reliable construction.

An even further object of the present invention is to provide a inflatable fireproof aviation body suit which is susceptible of a low cost of manufacture with regard to both materials and labor, and which accordingly is then susceptible of low prices of sale to the consuming public, thereby making such inflatable fireproof aviation body suit economically available to the buying public.

Still yet another object of the present invention is to provide a inflatable fireproof aviation body suit which provides in the apparatuses and methods of the prior art some of the advantages thereof, while simultaneously overcoming some of the disadvantages normally associated therewith.

Still another object of the present invention is to provide a inflatable fireproof aviation body suit for protecting a user during a plane crash.

Even still another object of the present invention is to provide a inflatable fireproof aviation body suit that includes a flexible inflatable suit constructed from a heat and flame resistant material. The inflatable suit has a plurality of discrete inflatable portions including a body portion, a pair of leg portions, and a hood portion. A carbon dioxide canister is mounted on the suit with a release mechanism coupled thereto. The canister is adapted to dispense carbon dioxide gas from an outlet thereof upon the actuation of the release mechanism. Next provided is a plurality of carbon dioxide tubes each coupled between the outlet of the carbon dioxide canister and the respective portion of the suit for inflating the same upon the actuation of the release mechanism associated with the carbon dioxide canister.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a cross-sectional view of one of the valves of the present invention.

FIG. 7 is a cross-sectional view of the valve of FIG. 6 in a closed orientation.

FIG. 8 is a cross-sectional view of the valve of FIG. 7 taken along line 8—8.

FIG. 9 is a perspective view of the enclosure of present invention.

DESCRIPTION OF THE PREFERRED EMBODIMENT

Figure 1:
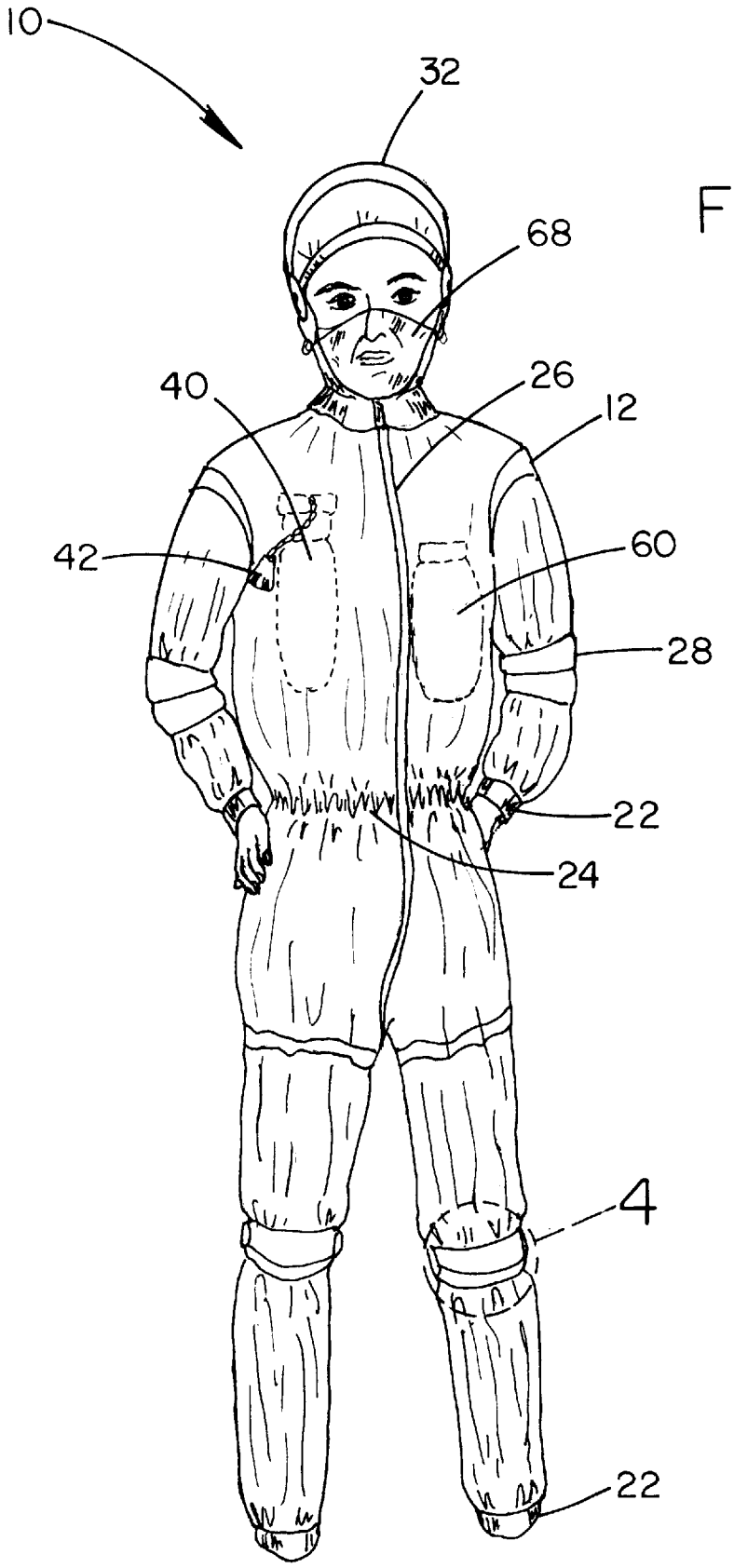
FIG. 1 is a front view of a inflatable fireproof aviation body suit according to the present invention.

With reference now to the drawings, and in particular to FIGS. 1 through 9 thereof, a inflatable fireproof aviation body suit embodying the principles and concepts of the present invention and generally designated by the reference numeral 10 will be described.

The present invention, as designated as numeral 10, includes a flexible inflatable suit 12 constructed from a heat and flame resistant material. In the preferred embodiment, such material takes the form of KEVLAR or NOMEX. The inflatable suit has a plurality of discrete and separate inflatable portions 14 including a body portion 16, a pair of arm portions 18, a pair of leg portions 19, and a hood portion 20. As an option, additional smaller discrete portions may be afforded by subdividing the foregoing portions. It is imperative to note that, in an alternate form, the suit has only the hood, arm, and body portions and thus resembles a jacket.

Figure 2:
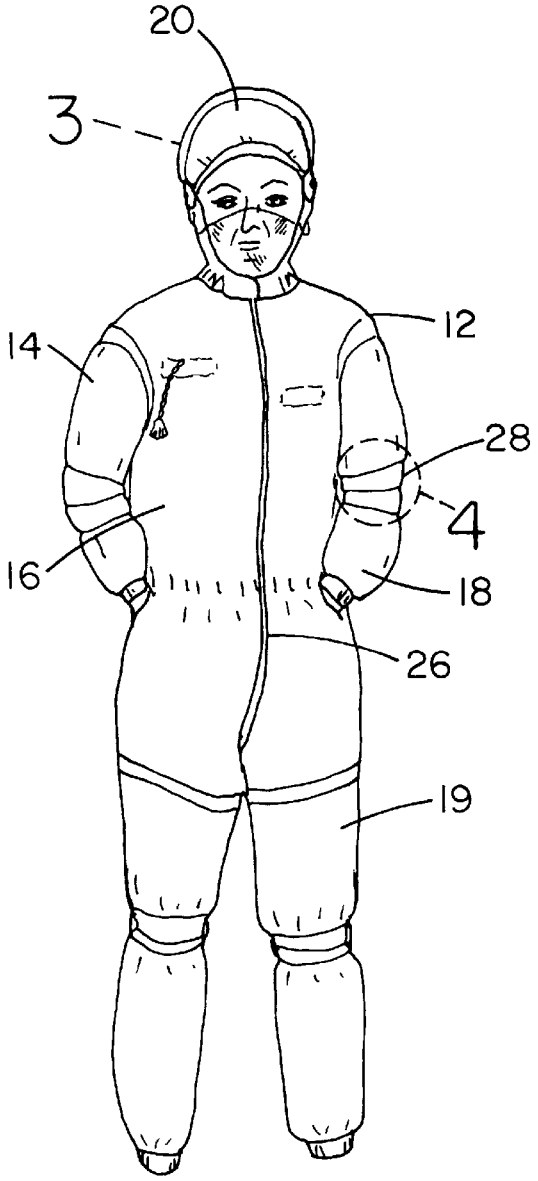
FIG. 2 is another front view of the present invention.

As shown in FIGS. 1 & 2, the suit has a plurality of elastic bands 22 mounted to bottoms of the leg and arm portions. An elastic band 24 is further mounted about a midpoint of the body portion for conforming the suit to a body of a user. For permitting the suit to be easily put on and taken off, a zipper 26 is mounted to a front side of the body portion of the suit.

Figure 4:
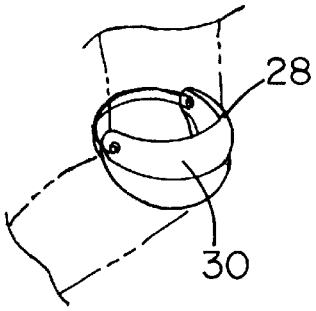
FIG. 4 is an illustration of one of the joints of the present invention.

FIG. 4 shows one of a plurality of rigid joint guards 28 each including a plurality of generally C-shaped segments 30. Each of such C-shaped segment ideally defines a portion of a sphere. Each joint guard is pivotally coupled at ends thereof about a common axis. The ends are, in turn, coupled about a respective leg and arm portion for protecting a joint associated therewith.

Figure 3:
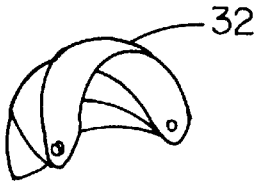
FIG. 3 is a perspective view of the helmet of the present invention.

As shown in FIG. 3, a rigid helmet 32 is provided with a semi-spherical configuration. During use, the rigid helmet is mounted to an exterior surface of the hood for protecting a head of the user. As an option, the helmet may be formed of the C-shaped segments, similar to the joint guards.

Figure 5:
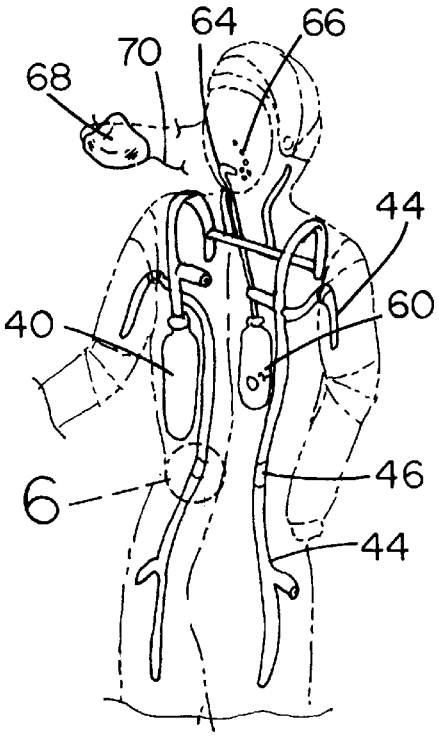
FIG. 5 is a perspective view of the various tubes of the present invention.

As best shown in FIG. 5, a carbon dioxide canister 40 is mounted within the body portion of the suit on a first side of the zipper. A release pull cord 42 is coupled to the carbon dioxide canister and extends from the suit for being gripped by the user. During use, the canister is adapted to dispense carbon dioxide gas from an outlet thereof upon the pulling of the cord. The carbon dioxide canister is equipped with a sufficient volume of gas to fill each compartment such that they are taut upon the pulling of the cord.

With reference still to FIG. 5, it is shown that a plurality of carbon dioxide tubes 44 are each coupled between the outlet of the carbon dioxide canister and the respective portion of the suit. The tubes serve for inflating the portions upon the single pulling of the cord associated with the carbon dioxide canister.

Associated therewith is a plurality of valves 46 each coupled within an associated one of the carbon dioxide tubes. Note FIGS. 6, 7 & 8. The valves each function to preclude the flow of carbon dioxide to one of the portions of the suit upon such portion being punctured.

To accomplish such, each valve includes an interior annular flange 50 formed in the associated tube. Adjacent thereto is a ring 52 mounted within the tube in concentric relationship with the flange. The ring has a plurality of apertures 54 formed therein along axes which reside in parallel with an axis of the ring. A stopper 56 is frictionally situated within the ring and has a first orientation for allowing air to flow through the apertures and flange into the corresponding portion of the suit. In a second orientation, the stopper abuts the flange thereby precluding the flow of air through the tube. It should be noted that the amount of friction between the stopper and ring is such that the flow of air about the stopper when the corresponding portion is being filled fails to afford enough force to move the stopper. In contrast, when the portion has a sudden release of pressure, as when punctured, the force exerted on the stopper is sufficient to slide the same to the second orientation thereof. It is imperative that the carbon dioxide canister release the gas at a limited rate for the stopper to function properly.

An oxygen canister 60 is mounted within the body portion of the suit on a second side of the zipper with a release pull cord is coupled thereto. Similar to the pull cord associated with the carbon dioxide canister, the present pull cord extends from the suit for being gripped by the user. In operation, the oxygen canister is adapted to dispense oxygen gas from an outlet thereof upon the pulling of the cord.

Coupled between the outlet of the oxygen canister and the hood of the suit is an oxygen tube 64. The oxygen tube is adapted for providing the user with oxygen upon the pulling of the cord associated with the oxygen canister. For directing oxygen into a space defined by the hood portion of the suit, a top extent 66 of the oxygen tube preferably has an inverted L-shaped configuration.

A transparent rigid or flexible mask 68 is provided. The mask serves to be removably worn on a face of the user with the oxygen tube situated within the mask during use. The securement of the mask on to the face of the user is preferably afforded by way of a strap 70.

Finally, a container 72 is provided having a rectilinear configuration with a square top and bottom face and a thin periphery formed therebetween for defining an interior space to store the suit. See FIG. 9. The periphery is equipped with a flexible handle strap 74 coupled thereto for totting purposes. When not in use, the container may be used as a seat cushion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective flight suit comprising, in combination:

a flexible inflatable suit constructed from a heat and flame resistant material, the inflatable suit having a plurality of discrete inflatable portions including a body portion, a pair of arm portions, a pair of leg portions, and a hood portion, the suit having a plurality of elastic bands mounted to bottoms of the leg and arm portions and further about a midpoint of the body portion for conforming the suit to a body of a user and a zipper mounted to a front side of the body portion of the suit for permitting the suit to be easily put on and taken off;

a plurality of rigid joint guards each including a plurality of generally C-shaped segments each pivotally coupled at ends thereof about a common axis, wherein the ends are in turn coupled about a respective leg and arm portion for protecting a joint associated therewith;

a rigid helmet with a semi-spherical configuration mounted to an exterior surface of the hood for protecting a head of the user;

a carbon dioxide canister mounted within the body portion of the suit on a first side of the zipper thereof with a release pull cord coupled thereto and extending from the suit for being gripped by the user, whereby the canister is adapted to dispense carbon dioxide gas from an outlet thereof upon the pulling of the cord;

a plurality of carbon dioxide tubes each coupled between the outlet of the carbon dioxide canister and the respective portion of the suit for inflating the same upon the pulling of the cord associated with the carbon dioxide canister;

a plurality of valves each coupled within an associated one of the carbon dioxide tubes for precluding the flow of carbon dioxide to one of the portions of the suit upon such portion being punctured;

an oxygen canister mounted within the body portion of the suit on a second side of the zipper thereof with a release pull cord coupled thereto and extending from the suit for being gripped by the user, whereby the oxygen canister is adapted to dispense oxygen gas from an outlet thereof upon the pulling of the cord;

an oxygen tube coupled between the outlet of the oxygen canister and the hood of the suit for providing the user with oxygen upon the pulling of the cord associated with the oxygen canister;

a transparent rigid mask adapted to be removably worn on a face of the user with the oxygen tube situated within the mask during use; and a container having a rectilinear configuration with a square top and bottom face and a thin periphery formed therebetween for defining an interior space for storing the suit, the periphery having a flexible handle strap coupled thereto for totting purposes, the container adapted to be used as a cushion when not in use.

2. A protective flight suit comprising:

a flexible inflatable suit constructed from a heat and flame resistant material, the inflatable suit having a plurality of discrete inflatable portions including a body portion, a pair of arm portions, and a hood portion, the inflatable suit having a vertically oriented zipper thereon;

a carbon dioxide canister mounted on the suit with a release mechanism coupled thereto, whereby the canister is adapted to dispense carbon dioxide gas from an outlet thereof upon the actuation of the release mechanism;

a plurality of carbon dioxide tubes each coupled between the outlet of the carbon dioxide canister and the respective portion of the suit for inflating the same upon the actuation of the release mechanism associated with the carbon dioxide canister;

an oxygen canister mounted on the suit on a side of the zipper opposite the carbon dioxide canister with a release mechanism coupled thereto, wherein the oxygen canister is adapted to dispense oxygen gas from an outlet thereof upon the actuation of the release mechanism and further included is an oxygen tube coupled between the outlet of the oxygen canister and the hood portion of the suit for providing the user with oxygen upon the actuation of the release mechanism associated with the oxygen canister;

a rigid helmet with a semi-spherical configuration mounted to an exterior surface of the hood portion for protecting a head of the user, the helmet including a plurality of rigid joint guards each including a plurality of generally C-shaped segments each pivotally coupled at ends thereof about a common axis; and a transparent rigid mask worn on a face of the user with the oxygen tube situated within the mask during use.

3. A protective flight suit as set forth in claim 2 wherein a plurality of valves are each coupled within an associated one of the carbon dioxide tubes for precluding the flow of carbon dioxide to one of the portions of the suit upon such portion being punctured.

4. A protective flight suit as set forth in claim 2 and further including a container defining an interior space for storing the suit, the container having a handle coupled thereto for totting purposes.

5. A protective flight suit as set forth in claim 2 wherein the release mechanism for the carbon dioxide canister has a pull cord which is actuated by the pulling thereof.

6. A protective flight suit as set forth in claim 2 wherein the suit further includes a pair of leg portions.

7. A protective flight suit as set forth in claim 2 wherein the suit has a plurality of elastic bands mounted about a midpoint of the body portion for conforming the suit to a body of a user.

8. A protective flight suit as set forth in claim 2 and further including a plurality of rigid joint guards.

9. A protective flight suit as set forth in claim 8 wherein each joint guard includes a plurality of generally C-shaped segments each pivotally coupled at ends thereof about a common axis.

* * * * *